United States Patent [19]

Schubert et al.

[11] 3,990,376

[45] *Nov. 9, 1976

[54] EASY OPENING CONTAINER WALL

[75] Inventors: James R. Schubert; Omar L. Brown, both of Dayton, Ohio

[73] Assignee: Ermal C. Fraze, Dayton, Ohio

[ * ] Notice: The portion of the term of this patent subsequent to Oct. 16, 1990, has been disclaimed.

[22] Filed: June 19, 1974

[21] Appl. No.: 480,835

Related U.S. Application Data

[60] Division of Ser. No. 336,404, Feb. 28, 1973, Pat. No. 3,837,524, and a continuation-in-part of Ser. No. 238,187, March 27, 1972, Pat. No. 3,765,352.

[52] U.S. Cl. ..... 113/121 C; 113/15 A

[51] Int. Cl.[2] ..... B21D 51/44

[58] Field of Search ..... 113/15 A, 121 C; 220/270, 90.6

[56] References Cited

UNITED STATES PATENTS

| | | | |
|---|---|---|---|
| 2,017,460 | 10/1935 | Hothersall | 113/15 A |
| 3,434,623 | 3/1969 | Cookson | 220/270 |
| 3,525,455 | 8/1970 | Saunders | 113/121 C |
| 3,696,961 | 10/1972 | Holk, Jr. | 220/54 |
| 3,705,563 | 12/1972 | Elser | 113/121 C |
| 3,765,352 | 10/1973 | Schubert et al. | 113/121 C |
| 3,871,314 | 3/1975 | Stargell | 113/15 A X |

*Primary Examiner*—Lowell A. Larson
*Attorney, Agent, or Firm*—George F. Smyth

[57] ABSTRACT

An easy opening container wall comprising a container wall of sheet material having a line of weakness therein defining a tear portion at least partially removable from the container wall. Removal of the tear portion provides a relatively sharp edge along the tear portion. A guard is provided along the periphery of the tear portion to protect the consumer from injury. The guard is interrupted adjacent the location at which the line of score is initially ruptured to facilitate such initial rupture. The outer periphery of the guard and the score line are configured and positioned relative to each other to minimize interference by the guard during the opening operation.

9 Claims, 12 Drawing Figures

EASY OPENING CONTAINER WALL

CROSS REFERENCE TO RELATED APPLICATION

This is an divisional application of application Ser. No. 336,404, filed on Feb. 28, 1973 for EASY OPENING CONTAINER WALL, now U.S. Pat. No. 3,837,524, and a continuation-in-part of Ser. No. 238,187 filed Mar. 27, 1972, now U.S. Pat. No. 3,765,352.

BACKGROUND OF THE INVENTION

As is well known, when an easy opening container is opened, a tear portion or panel is torn from the container to form an opening. The tearing of the sheet material leaves a relatively sharp edge on the removed panel and also leaves a relatively sharp edge on the rim of the opening. These sharp edges are potential sources of danger to the consumer particularly if the container or removed panel is carelessly handled.

This problem is particularly acute in the so-called full panel pullout in which the removed panel covers a major area of the can end. These full panel pullout ends are often used on a food product such as pudding, some of which may adhere to the inner or non-public side of the panel. When this occurs, the consumer may lick the inner surface of the removed panel and by so doing may cut his tongue. This of course is only one example of how one of the sharp edges on the panel can produce injury.

In our earlier copending application, this problem is solved by a protector or guard on the tear portion which extends along the periphery of the tear portion. The guard provides a relatively dull surface adjacent the sharp edge which shields the user from the sharp edge.

In one form, the guard includes multiple layers of sheet material formed integrally with the tear portion. Although the guard very adequately solves the injury problem, it introduces two additional problems. First, the guard inhibits the initiation of severance of the sheet material along the line of weakness. Specifically, easy opening container walls of this type are typically opened by depressing a peripheral segment of the tear portion inwardly. The guard, which may be in the form of a relatively stiff guard bead on the inner side of the tear portion, resists inward movement of the peripheral segment. Therefore, the initial "pop" is more difficult to obtain.

Following the initial pop, a paddle section of the tear portion is bent inwardly, usually about a bend zone, to rupture a segment of the sheet material along the line of weakness. This inward bending of the paddle section is typically brought about by pivotal movement of the opening tab.

Following such pivotal movement of the tab, the user pulls outwardly on the tab to pull out the panel from the container wall. The guard, however, has an edge which lies radially outwardly of the line of weakness. This edge tends to hang up during the initial pull on the tab so that the initial portion of the pulling phase of the opening operation is made more difficult.

SUMMARY OF THE INVENTION

The present invention facilitates the initial severance or pop of the sheet material at the line of weakness by interrupting the guard at the peripheral segment of tear portion which is depressed inwardly. Interruption of the guard could be a simple absence of the guard at the peripheral segment. However, this would mean a loss of protection at the peripheral segment. Accordingly, a better form of interruption is an appropriate discontinuity of the guard without completely eliminating it.

In one preferred form of the invention, the guard includes a guard bead located axially inwardly of the line of weakness. With this construction, the guard is interrupted at the peripheral segment by spacing the guard bead axially inwardly from the peripheral segment to thereby allow the peripheral segment to be forced inwardly to initiate rupture of the sheet material without substantial interference from the guard bead. Another advantage of this construction is that when the peripheral segment is forced inwardly, it is deformed into substantial contact with the guard bead. Accordingly, the guard bead, once the tear portion is removed, is fully effective, even at the peripheral segment, to protect the user against injury.

The present invention also facilitates the initial pull phase of the tear portion removal operation. The guard has an edge on the inner or nonpublic side of the container wall which extends generally along the line of weakness. The edge of the guard lies radially outwardly of the line of weakness along a major portion of the line of weakness to thereby provide maximum protection against injury from the sharp edge. However, the edge lies slightly radially inwardly adjacent the portions of the line of weakness which are ruptured by the initial pull on the tab. As the edge lies radially inwardly of these portions of the line of weakness, it cannot increase the resistance to the initial pull of the tab. Although the edge may lie slightly radially outwardly of a major portion of the line of weakness, it has been found that this does not create any significant resistance to the pulling phase of the removal operation after the initial pull is accomplished.

The present invention also provides a novel and advantageous method of making a double fold in sheet material. This method can be used to particular advantage in constructing a preferred form of the easy opening container wall of this invention.

According to the method of this invention, a piece of sheet material is provided with the sheet material having first and second axially offset radial sections integrally joined by a generally axial wall. The second radial section has an expansion rib formed integrally therewith adjacent the axial wall.

Next axially directed compressive forces are applied to the expansion rib to completely flatten the rib. Flattening of the rib results in the application of a radial outward force to the adjacent end of the axial wall. The effect of collapsing the expansion rib is to incline the axial wall in a known direction so that when axial compressive forces are applied to the two radial sections a double fold will be provided. As this double fold or pair of reverse bends is of the type which can be used to form a guard for the easy opening container wall of this invention, this method is particularly adapted for use in making the preferred form of the easy opening container wall.

Another feature of the method of this invention is the manner in which the guard bead is caused to be spaced from the peripheral segment of the tear portion which is first ruptured by the tab. This can be advantageously accomplished by providing a space into which the guard can move during the work operation which results in the formation of the guard.

The invention can best be understood by reference to the following description taken in connection with the accompanying illustrative drawings.

DESCRIPTION OF THE PREFERRED EMBODIMENT

Figure 1:
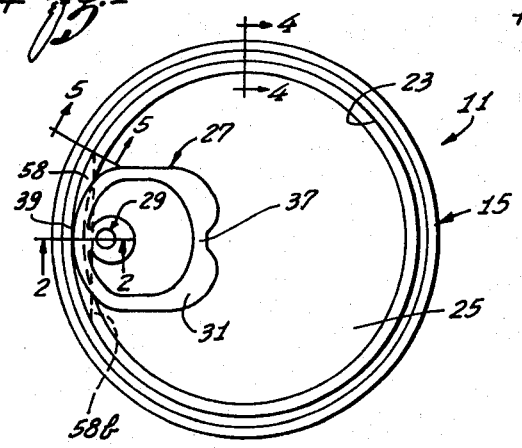
FIG. 1 is a top plan view of an easy opening container having a protector to protect the user against injury from the sharp edge of the tear portion.

FIGS. 1–5 illustrate an easy opening container 11 in the form of an easy opening can. The container 11 includes a generally cylindrical peripheral wall 13 of sheet material, the upper end of which is closed by an easy opening container or end wall 15 which is attached to the upper end of the peripheral wall by interlocking flanges 17 and 19. The lower end or bottom of the peripheral wall 13 can be closed in any conventional manner such as by an end wall integral therewith or by an end wall which is attached to the lower end of the peripheral wall in a conventional manner.

The peripheral wall 13 may be of conventional construction except for an annular rib 21 which projects radially inwardly closely adjacent and beneath the wall 15.

The easy opening container wall 15 is constructed of sheet material such as aluminum or an aluminum alloy. The easy opening container wall 15 has a line of weakness in the form of a score line 23 which defines a relatively large panel or tear portion 25 which can be removed from the container 11. The panel 25 covers a major portion of the area of the container wall 15 and has an inner or non-public surface 26. The configuration of the score line 23 is described in connection with FIGS. 4–6. An annular coined region 26*a* of reduced thickness extends along the score line 23.

A tab 27 is attached to the panel 25 in any suitable manner such as by a hollow rivet 29. Although the tab 27 could be of various constructions, in the embodiment illustrated, it is of the type disclosed in common assignee's copending application Ser. No. 64,291, now U.S. Pat. No. 3,710,349. The tab 27 is integrally constructed from a single piece of sheet metal and generally includes a tab body or lever 31 and an attaching portion or ear 33 which is connected to the tab body 31 by a connecting wall 35. The rivet 29 projects through the attaching ear 33 to attach the tab 27 to the panel 25. The tab body 31 has a lifting end 37 and a rupturing flange 39 at opposite ends thereof.

The tab body 31 has an outer reinforcing curl 43 which extends substantially completely around the tab body except for the rupturing flange 39. Adjacent the connecting wall 35, the curl 43 has legs 45 and 47 connected by a bend portion 49 which the latter being engageable with the connecting wall 35. The bend portion 49 is round and acts to support the connecting wall during manipulation of the tab.

Figure 2:
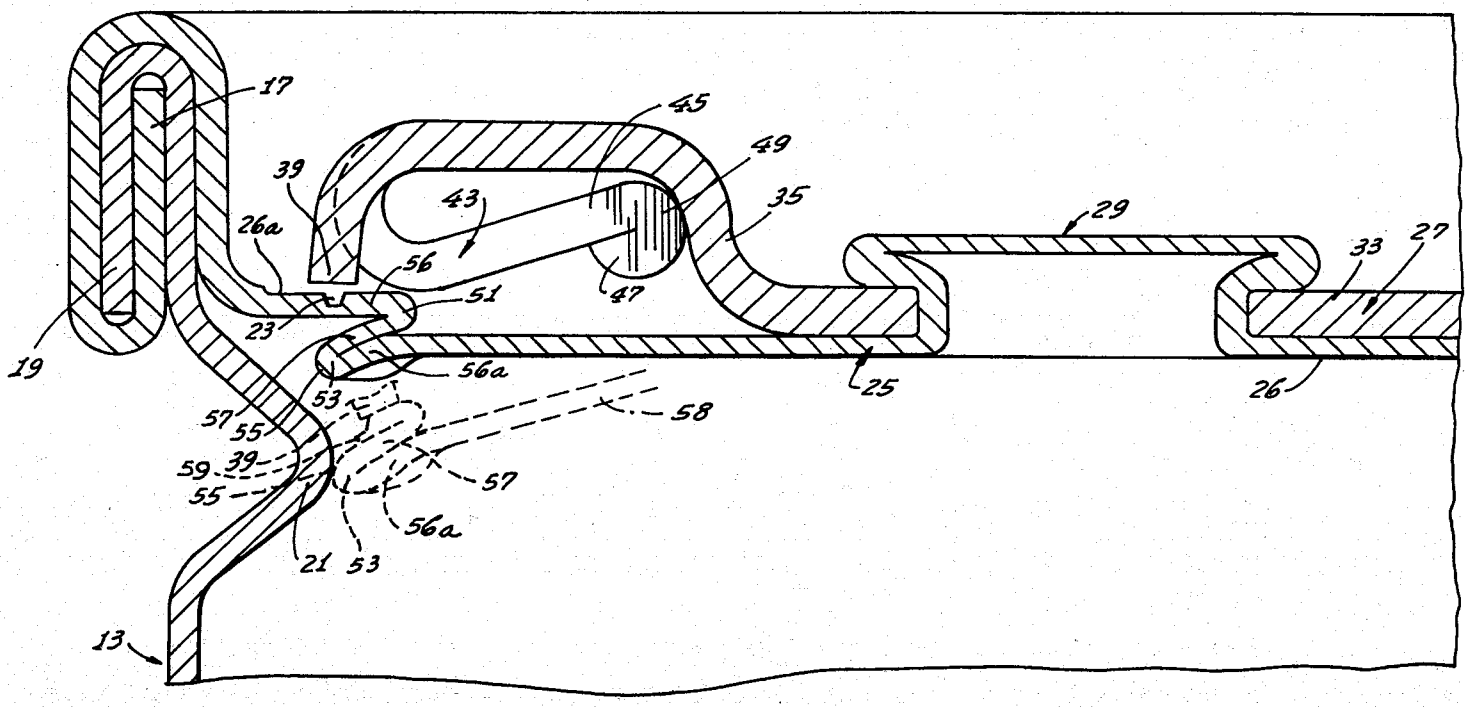
FIG. 2 is an enlarged fragmentary sectional view taken generally along line 2—2 of FIG. 1.

An outer or marginal region of the panel 25 has the sheet material thereof bent to form an outwardly opening reverse bend portion 51 and an inwardly opening reverse bend portion 53. The bend portion 53 has a smooth dull surface or outer peripheral edge 55 which lies adjacent the score line 23. As shown in FIG. 2, the reverse bends 51 and 53 are joined to the score line 23 and to the panel 25, respectively. The reverse bends 51 and 53 are interconnected by a connecting leg 57 which forms an intermediate layer of the marginal portion of the panel 25. As shown in FIG. 2, the reverse bend 53 lies axially inwardly of the score line 23.

Figure 4:
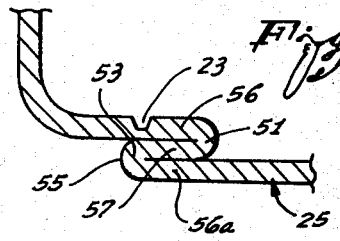

More specifically, a marginal region of the panel 25 is bent to form an upper layer 56 of sheet material, a lower layer 56*a* of sheet material and the intermediate layer or connecting wall 57. All of the layers 56, 56*a*, and 57 are annular and extend continuously around the marginal portion of the panel 25. The layers 56, 56*a* and 57 and the bends 51 and 53 form a guard bead. At all locations along the score line 23 except for the region adjacent the rupturing flange 39 (FIG. 2) the layers 56 and 56*a* and 57 are substantially parallel, and the layers 56 and 56*a* are flattened against the intermediate layer 57, as shown in FIG. 4. With this construction, the intermediate layer 57 abuts the upper layer 56 over substantially the full length of the intermediate layer.

However, at the region of the score line 23 adjacent the rupturing flange 39, the intermediate layer 57 is not bent into tight supporting engagement with the upper layer 56. Rather, as shown in FIG. 2, the intermediate layer 57 projects radially outwardly and axially inwardly in extending from the bend 51 to the bend 53. With this construction, the intermediate layer 56 is not backed up or supported immediately axially inwardly of the score line 23. This facilitates the initiation of severance of the sheet material along the score line 23, i.e., the initial pop.

When the lifting end 37 of the tab 27 is raised, the connecting wall 35 of the tab readily bends to allow the tab body 31 to pivot relative to the attaching ear 33. This forces the rupturing flange 39 against the sheet material at a region of the score line 23 and tends to force a peripheral segment of the layer 56 so engaged by the rupturing flange 39 axially inwardly. If the intermediate layer 57 were in tight engagement with the inner face of the layer 56, it would support the latter, and therefore resist the inwardly directed force applied by the rupturing flange 39. However, with this invention, the layers 56*a* and 57 are spaced axially at the region axially inwardly of the rupturing flange 39 so that the layer 56 is unsupported in this region. Accordingly, the region of the score line 23 engaged by the rupturing flange 39 is ruptured with about the same ease as though the guard bead were not provided.

Figure 3:
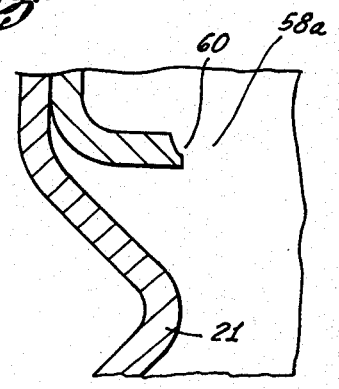
FIG. 3 is a fragmentary sectional view of the container with the panel removed.

Upon continued pivotal movement of the tab body 31, the tearing of the sheet material along the score line 23 continues to thereby rupture a segment of the line of weakness. Such pivotal movement of the tab body 31 also bends a paddle section 58 of the panel 25 inwardly into the container 11 to form an opening 58*a* (FIG. 3). The inward pressure applied to the layer 56 by the flange 39 may tend to bend the layer 56 into engagement with the layer 57 as shown in phantom lines in FIG. 2. The tab 57 is then pulled outwardly to rupture the remainder of the sheet material along the score line 23 thereby removing the panel 25 from the container 11.

The rupture of the sheet material forms a relatively sharp edge 59 on the panel 25 as shown in dashed lines in FIG. 2 and a relatively sharp edge 60 on the container (FIG. 3). The dull surface or edge 55 preferably lies closely adjacent the sharp edge 59 to form a shield or partial sheath therefor. In addition, the edge of the panel 25 is thick because it is defined by the three layers of sheet material 56, 56*a* and 57. These two factors combine to make it extremely difficult to be injured by the sharp edge 59.

The rib 21 on the peripheral wall 13 preferably projects radially inwardly so that the edge 55 of the paddel section 58 just clears the rib 21 as the paddle section is bent inwardly of the container 11. As shown in FIG. 3, the rib 21 projects radially inwardly through a location which is in substantial alignment with the sharp edge 60. Thus, the rib 21 serves as a guard to make cutting contact with the sharp edge 60 much more difficult.

Figure 6:
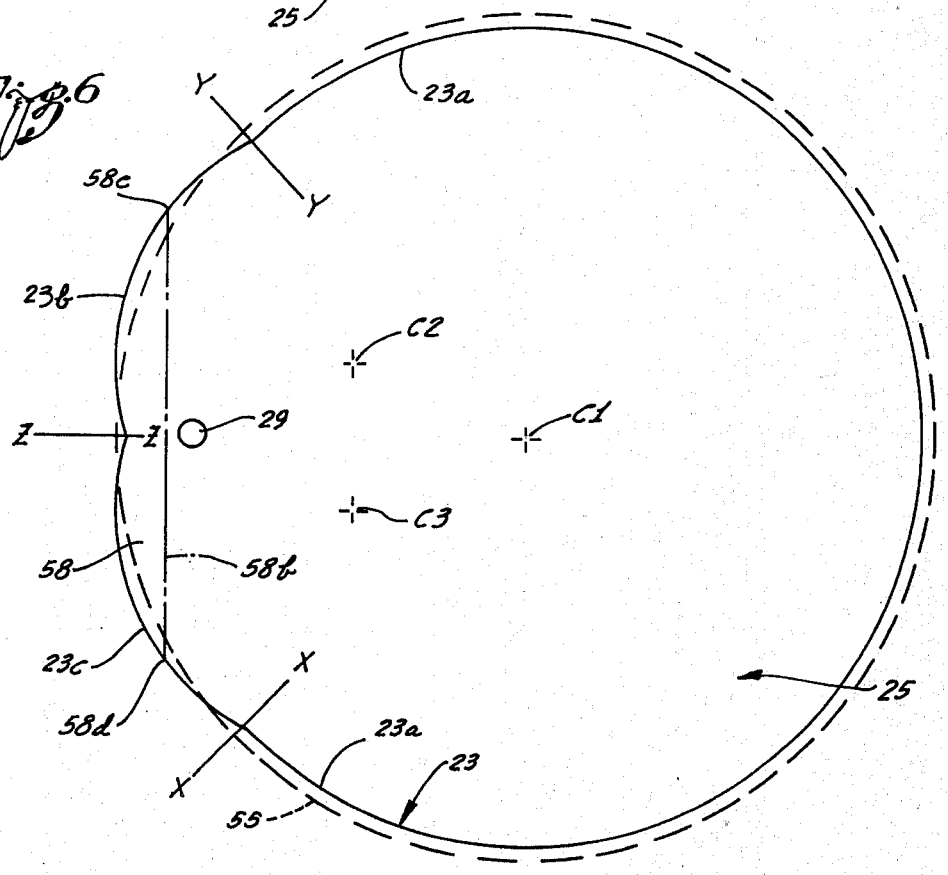
FIG. 6 is a schematic plan view of the container wall with the tab removed showing the relationship between the peripheral edge of the guard and the score line.

To facilitate the initial pull of the tab 27, the present invention provides certain relationships between the edge 55 and the score line 23. With reference to FIG. 6, pivotal movement of the tab body 31 bends the paddle section 58 inwardly about a bend zone or line 58*b*. Although the bend line 58*b* is shown as a straight line in FIGS. 1 and 6, obviously it may have other configurations. This results in tearing of a segment of the score line 23 lying intermediate points 58*c* and 58*d* which define the ends of such segment and the ends of the bend line 58*b*.

The present invention orients the edge 55 and the score line 23 in such a way as to achieve maximum protection from injury to facilitate the initial pull of the tab 27. To obtain maximum protection, the edge 55 preferably lies slightly radially outwardly of the score line 23 so that it can better protect the user against injury from the sharp edge 59. On the other hand, it has been found that if the edge 55 lies radially outwardly of the score line 23 adjacent the points 58*c* and 58*d*, the edge 55 tends to hang up on the rim of the opening 58*a* (FIG. 3). Accordingly, this invention provides for locating the edge 55 radially outwardly of the score line 23 along substantially all of the score line except for the regions of the score line adjacent the points 58*c* and 58*d*.

A preferred way of configuring and positioning the score line 23 and the edge 55 is shown in FIG. 6. The edge 55 is circular in plan. The score line 23 contains a circular portion 23*a* which is concentric with the edge 55. The circular portion 23*a* is a major portion of the score line 23 and, in the form shown in FIG. 6, extends for approximately 270° of the score line. Obviously, the circular portion 23 may extend through arcs other than 270°.

The score line 23 also includes a pair of arcuate sections 23*b* and 23*c* which, in the embodiment illustrated, extend through the same number of degrees and have radii of identical lengths. The radii of the arcs 23*b* and 23*c* are smaller than the radius of the circular portion 23*a*, and for this reason each of the arcs 23*b* and 23*c* forms a hump on the score line 23. The circular portion 23*a* terminates at reference lines X—X and Y—Y. The arcs 23*b* and 23*c* intersect at reference line Z—Z, which is a radial line along which the rupturing flange 39 engages the score line 23, and terminate at lines Y—Y and X—X, respectively.

Figure 5:
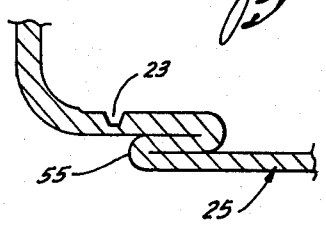
FIGS. 4 and 5 are enlarged fragmentary sectional views taken generally along lines 4—4 and 5—5, respectively, of FIG. 1.

With this construction, the edge 55 lies slightly radially outwardly of the circular portion 23*a* as shown in FIGS. 4 and 6. At and adjacent the points 58*c* and 58*d*, the edge 55 lies slightly radially inwardly of the score line as shown in FIG. 5. At and adjacent the rupturing flange 39 (reference line Z—Z in FIG. 6) the edge 55 lies radially outwardly of the score line 23 as shown in FIGS. 2 and 6. The location of the points 58*c* and 58*d* may vary depending upon the manner in which the tab body 31 is manipulated. Accordingly, it is preferred to have the edge 55 lie radially inwardly of the score line 23 along regions of sufficient length to accommodate all reasonable variations in locations of the points 58*c* and 58*d*.

In FIG. 6, the humps formed by the arcs 23*b* and 23*c* have been exaggerated for clarity. In actual practice, the score line 23 may appear to be substantially circular in plan. In the embodiment illustrated, the arcs 23*a*, 23*b* and 23*c* have centers, C1, C2, and C3, respectively.

With the construction shown diagrammatically in FIG. 6, the edge 55 lies radially inwardly of the score line 23 and hence from the edge 60 (FIG. 3) at the points 58*c* and 58*d*. Accordingly, the edge 55 cannot hinder removal of the tear portion 25. The edge 55 even where located radially inwardly of the score line 23 is sufficiently close to the sharp edge 59 to afford substantial protection. In addition, tongue injuries of the type described hereinabove are less likely to be caused on the paddle section 58 because this portion is bent and not as easy to lick.

Figure 8:
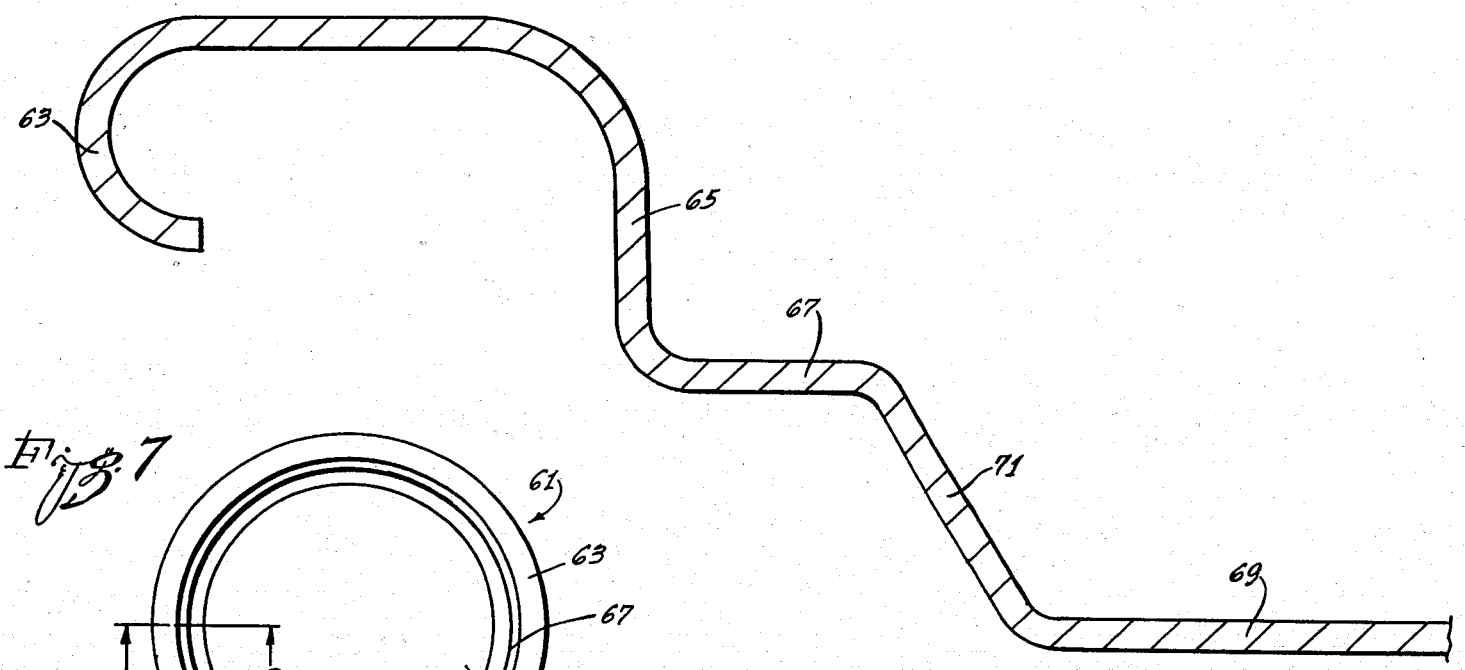
FIG. 8 is a fragmentary sectional view taken along line 8—8 of FIG. 7.
Figure 7:
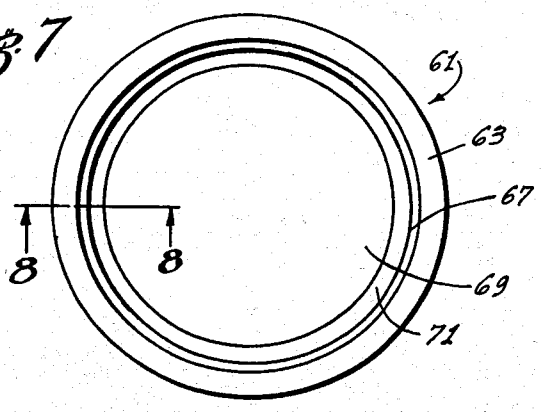
FIG. 7 is a top plan view of a can end blank.

FIGS. 7–12 illustrate a preferred method of constructing the easy opening container wall 15 shown in FIGS. 1–6. FIGS. 7 and 8 show a can end blank 61. The blank 61 includes a peripheral attaching flange 63, an axial wall 65 and a pair of radial walls or sections 67 and 69 which are axially offset and interconnected by a generally axial or connecting wall 71. In the embodiment illustrated, the section 67 and the wall 71 are annular, and the section 69 is circular. The blank 61 may be formed into this configuration with any suitable tooling.

Figure 9:
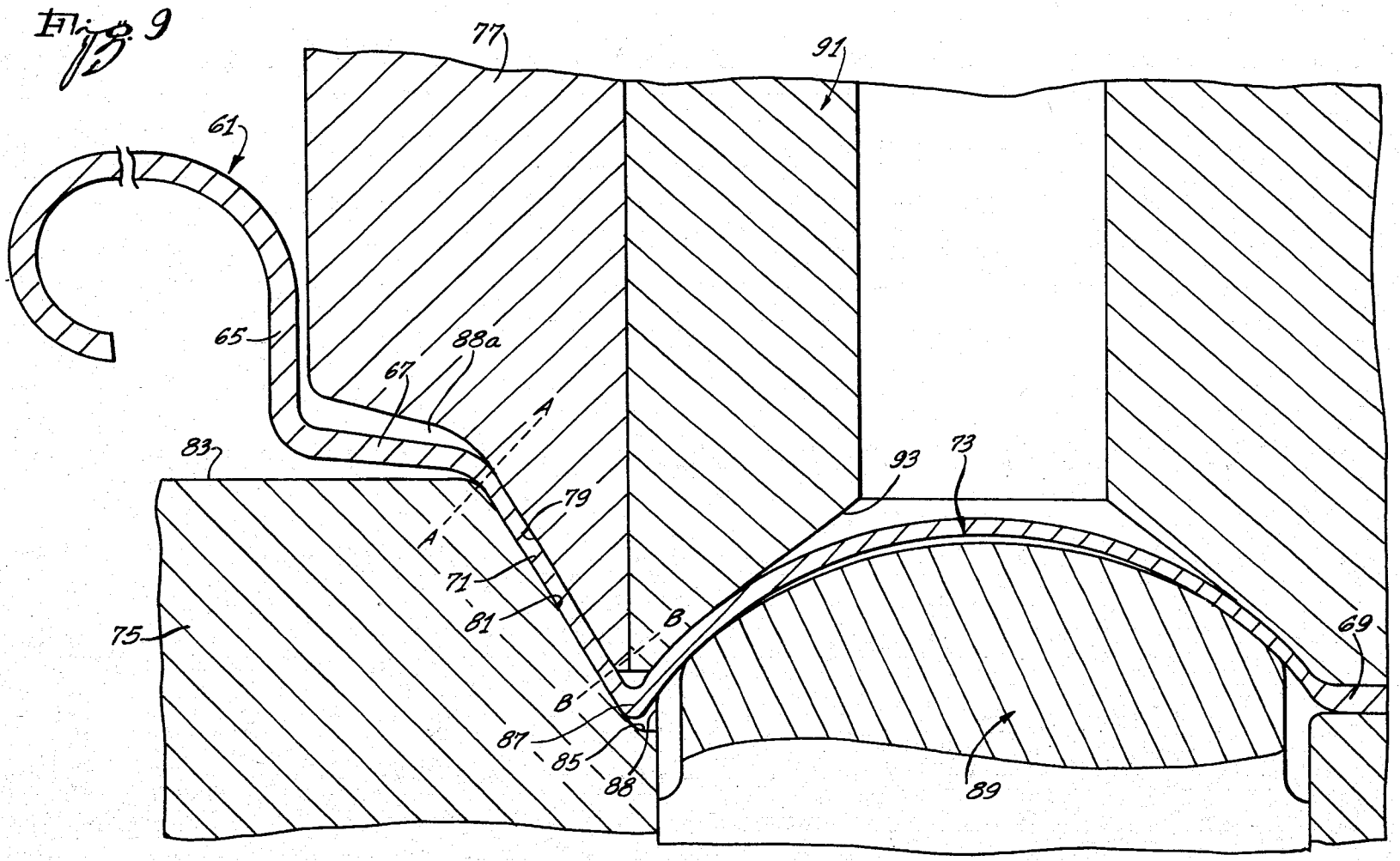
FIG. 9 is a sectional view taken on an axial plane and illustrating the tooling for forming a dimple and for coining the connecting wall.

FIG. 9 shows a first work operation in which a dimple 73 is formed and in which the connecting wall 71 is coined to elongate the same. In FIG. 9, the connecting wall 71 is squeezed between a lower coining die 75 and an upper coining die 77 with the compressive force being sufficient to cause thinning and consequent generally axial elongation of the connecting wall 71. The elongation of the connecting wall 71 facilitates formation of the reverse bends 51 and 53. Specifically, the dies 75 and 77 have coining surfaces 79 and 81, respectively, which coin the sheet material between reference lines A—A and B—B. The lower coining die 75 also has horizontal supporting surfaces 83 and 85 for supporting the radial section 67 and an annular region 87 which extends between the connecting wall 71 and the dimple 73. The tooling provides spaces 88 and 88*a* to accommodate the elongation of the connecting wall 71.

The dimple 73 is formed by a punch 89 and a cooperating die 91. The punch 89 engages the sheet material of the section 69 and offsets a zone of the same into a die cavity 93. Ultimately the offset sheet material is engaged between the cooperating surfaces of the punch 89 and the die 91 to coin the sloping wall of the dimple. The coined regions are generally those portions of the dimple 73 which are shown in FIG. 9 as being compressively engaged. A dimple making process which involves stretching and coining of the sheet material is disclosed in common assignee's U.S. Pat. No. 3,638,597. The annular region 87 is not coined during the work operation illustrated in FIG. 9.

Figure 10:
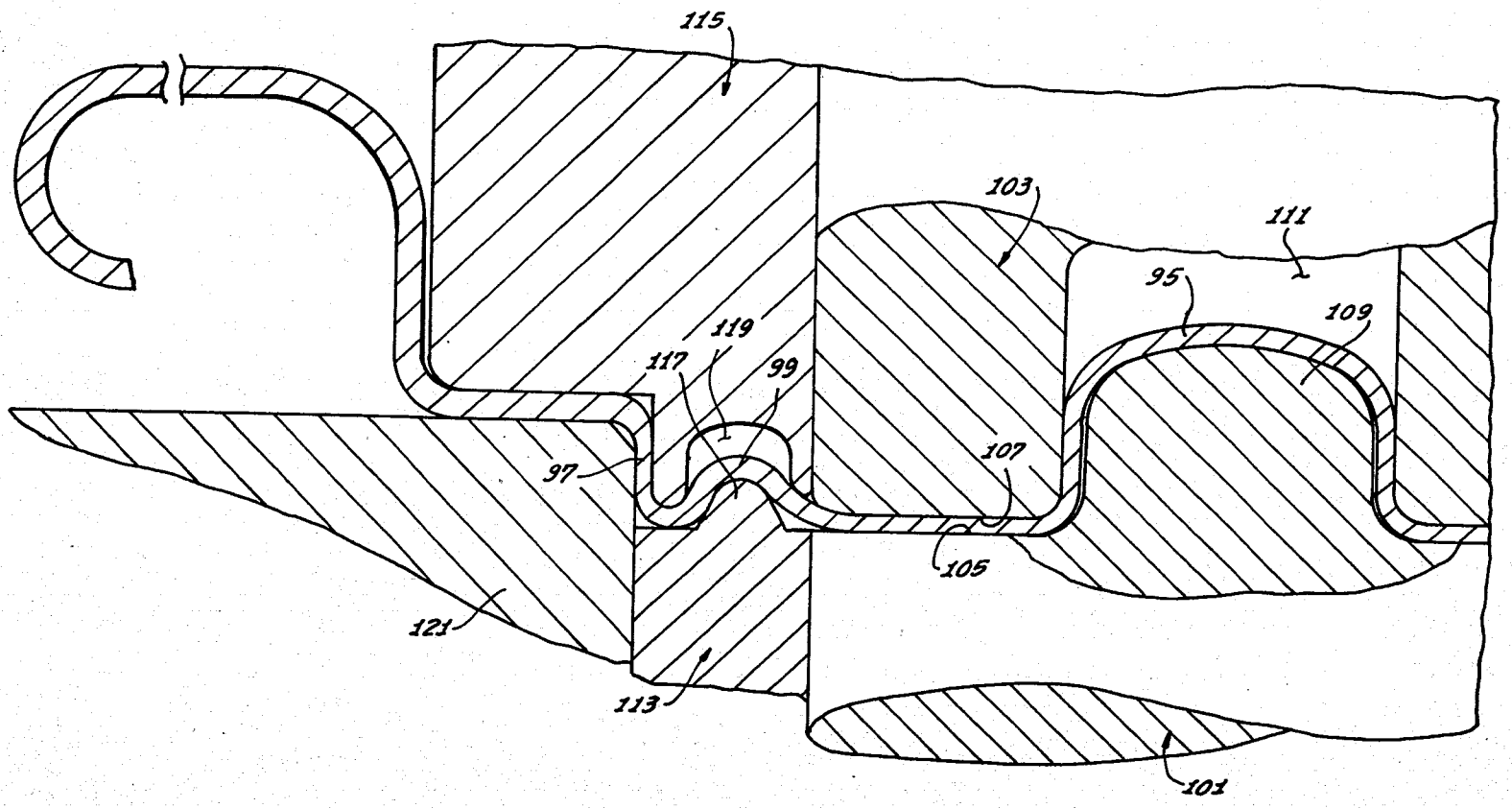
FIG. 10 is a sectional view taken on an axial plane showing the tooling for converting the dimple into a hollow rivet and for formation of the rib.

In the work operation shown in FIG. 10, the dimple 73 is converted into a hollow rivet 95 and the connecting wall 71 is converted into a shorter connecting wall or axial wall 97 and an annular expansion rib 99 which lies between the wall 97 and the rivet 95. The wall 97 extends substantially axially whereas the connecting wall 71 (FIG. 9) is inclined or sloped relative to the axis of the blank 61. The annular expansion rib 99 is closely adjacent the wall 97.

The dimple 73 is converted into the rivet 95 by a rivet punch 101 and a rivet die 103. An outer annular region of the dimple 73 is collapsed and flattened between working faces 105 and 107 of the punch 101 and the die 103, respectively. The punch 101 has a head 109 which is within the rivet 95 to assist the formation thereof, and the rivet 95 is in a die cavity 111.

The expansion rib 99 is formed by stretching and deformation of the sheet material of the connecting wall 71 by a punch 113 and a die 115. The punch 113 has a head 117 which engages the sheet material and forces the same into a die cavity 119.

The wall 97 is formed from the upper regions of the connecting wall 71. This is accomplished by the punch 113, the die 115 and a tool 121. In addition, the die 115 cooperates with the tool 121 to bend the sheet material at the juncture of the section 67 and the wall 97 so that the wall 97 extends in a substantially axial direction.

Figure 11:
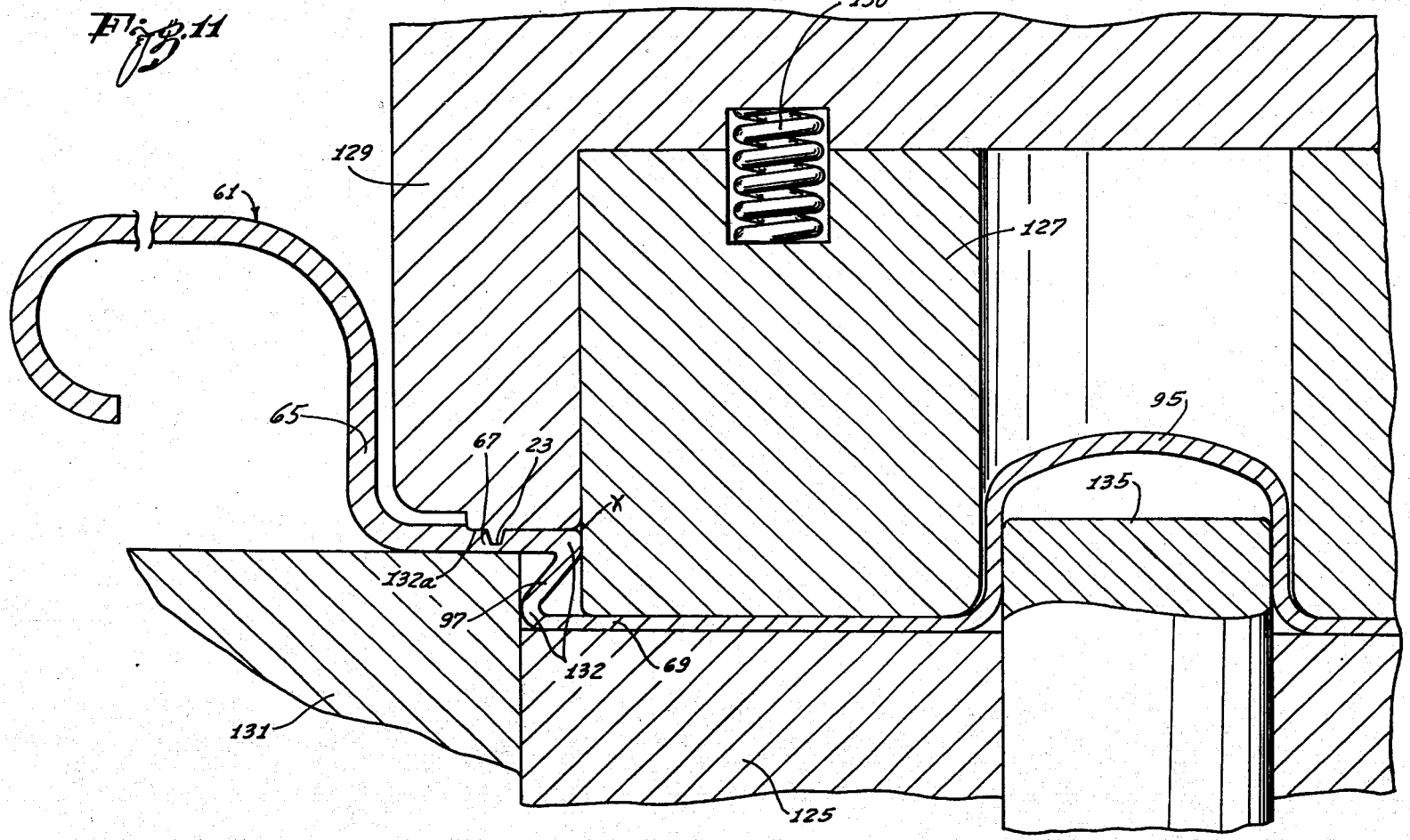
FIG. 11 is a sectional view taken on an axial plane and illustrating the tooling for initiating axial collapse of the rib and axial compression of the radial sections.

In the work operation shown in FIG. 11, the score line 23 is formed and an axial compressive force is applied to the expansion rib 99 by a pair of compression tools 125 and 127 to completely flatten the expansion rib. The scoring operation can advantageously be carried out by a scoring die 129 and by a tool 131 which supports the section 67. A spring 130 urges the die 129 and the tool 127 in opposite directions. In addition, a punch 135 is partially inserted into the rivet 95.

The tool 127 and the die 129 are advanced relative to the tools 125 and 131. The tool 127 strikes the upper end of the expansion rib 99 to initiate axial collapse and radial expansion thereof. Radial expansion of the expansion rib 99 moves the lower end of the axial wall 97 radially outwardly with the wall 97 pivoting about regions 132. This creates a generally Z-shaped cross section with the wall 97 extending both axially and radially. In addition, as the scoring tool 129 is relatively advanced, it applies an axial compressive force to the radial sections 67 and 69 with the result that the wall 97 becomes more inclined relative to the axis of the blank 61 in the manner shown in FIG. 7. The expansion rib 99 is completely collapsed in the work operation of FIG. 11.

During the operation shown in FIG. 11, the sheet material adjacent the ultimately formed score line 23 is confined by the tool 131 and the scoring die 129. As the die 129 and the tool 131 relatively advance, the sheet material between the die 129 and the tool 131 is compressively engaged to hold the section 67 in position and to form the score line 23. At the end of the stroke the sheet material radially outwardly of the score line 23 is coined by a coining face 132*a*, and this further tends to hold the section 67 in position during the last bit of radial expansion of the expansion rib in the operation of FIG. 11. Ordinarily, the material radially inwardly of a point X will be thinner than the material radially outwardly of the score line 23 as a result of the coining operation of FIG. 9, and consequently the face 132*a* will not ordinarily coin the material radially inwardly of the score line.

By confining and compressively engaging the sheet material adjacent and along the score line 23 to prevent movement thereof, stresses of the type which might create tiny cracks or openings in the sheet material along the score line are less likely to occur. In addition, slight coining adjacent the score line 23 is believed beneficial to the characteristics of the sheet material along the score line.

Figure 12:
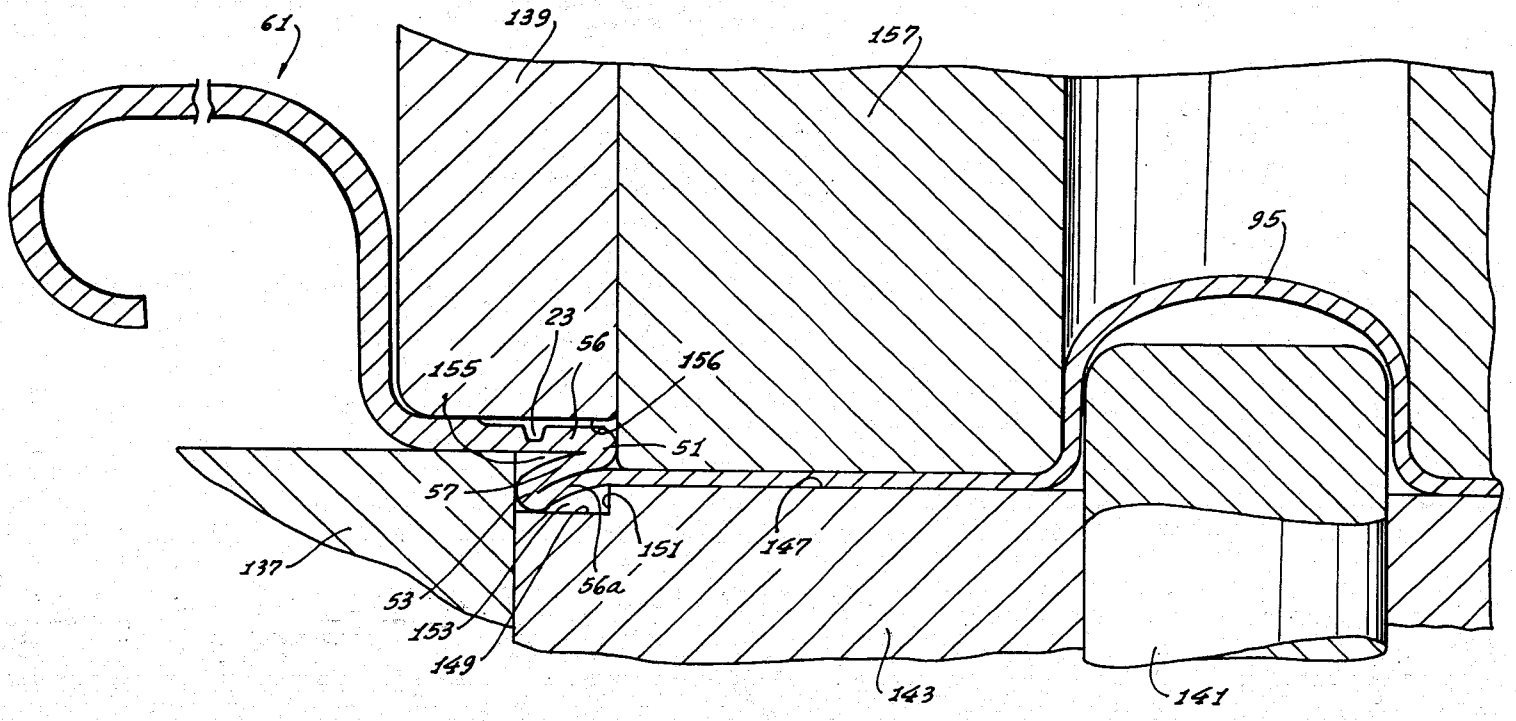
FIG. 12 is an enlarged fragmentary sectional view taken on an axial plane illustrating the axial compression of the container wall to form two reverse bend sections.

FIG. 12 illustrates the next work operation in which the radial sections 67 and 69 are moved toward each other with consequent collapse of the wall 97 to form reverse bend sections 51 and 53 substantially as shown in FIG. 2. During the work operation of FIG. 12, the blank 61 is retained between tools and workholders 137 and 139, and the punch 141 is received within the rivet.

A compression tool 143 is moved upwardly and cooperates with the tool 139 to at least partially collapse the wall 97 (FIG. 11) to thereby form the reverse bends 51 and 53. Specifically, the compression tool 143 has an annular working face 147 which is continuous and planar except for a peripheral segment of the tool 143 at which a radial shoulder 149 and an axial shoulder 151 cooperate to define a recess 153. The recess 153 is formed at the periphery of the tool 143 and extends circumferentially for a very short distance.

The recess 153 increases the spacing between the tools 139 and 143 over what it would be without the recess. Accordingly, the sheet material is not compressed as much by the tools 139 and 143 at the recess 153 as it is where the recess does not exist.

Specifically, the tools 139 and 143 squeeze and completely collapse the wall 97 to form the configuration shown in FIG. 4 at all locations which do not confront the recess 153. This squeezing action of the tools 139 and 143 converts the regions 132 (FIG. 11) into the bends 51 and 53, respectively, and the wall 97 (FIG. 11) into the intermediate layer 57 as shown in our copending application referenced hereinabove.

At the recess 153, the greater spacing between the tools 139 and 143 makes it possible for the layers 56, 56*a*, and 57 not to be folded tightly against each other. At the beginning of the work operation of FIG. 12, the layer 56 is supported from above by a flat annular working face 156 of the tool 139, and the layer 56*a* is unsupported from below. Accordingly, the relative advance of the tools 139 and 143 forces the unsupported layer 56*a* into the recess until the bend 53 engages the shoulder 149. This prevents the intermediate layer 57 from being bent up tight against the upper layer 56. This leaves a space 155 between the layers 56 and 57 along the circumferential length of the recess 153 as shown in FIG. 12. Thus, the circumferential dimension of the recess 153 should be selected in accordance with the desired circumferential dimension of the cross section shown in FIG. 12, i.e., the circumferential dimension of the interruption of the guard bead. The tool 143 also cooperates with a pressure pad 157.

Some of the material of the connection wall 171 (FIG. 8) is used to form the reverse bends 51 and 53. Because the connecting wall 71 has been thinned, the reverse bends 51 and 53 are more easily formed and are less likely to have cracks.

Following the work operation of FIG. 12, the tab 27 (FIGS. 1 and 2) can be attached to the blank 61 by heading of the rivet 95 to thereby convert the latter into the rivet 29 (FIGS. 1 and 2). Thereafter, the resulting easy opening container wall can be attached to the container 11 as shown in FIG. 2.

Although the method shown in FIGS. 7–12 is particularly adapted for making an easy opening container wall of the type shown in FIG. 2, it may be used in other instances where it is desired to form a double fold or double reverse bend sections.

Although exemplary embodiments of the invention have been shown and described, many changes, modifications and substitutions may be made by one having ordinary skill in the art without necessarily departing from the spirit and scope of this invention.

We claim:

1. A method of making a double fold in sheet material, which double fold is formed on the center panel of an easy opening container and which panel with the double fold thereon is removed by rupture of a scoreline, comprising:

providing a piece of sheet material having first and second axially offset radial sections integrally joined by a connecting wall;

said first radial section being vertically above said second section;

expansion bead means located radially inwardly of said second radial section collapsing said expansion bead whereby said first and second radial sections and said connecting wall are formed to a configuration which is generally Z-shaped in cross-section with the first and second sections forming the top and bottom legs of said Z respectively, and the connecting wall forming the connecting leg thereof, providing first and second tools, said second tool having a recess therein;

relatively positioning the tools and the sheet material so that the tools are on opposite sides of the radial sections and said recess confronts the second radial section adjacent the connecting wall; and applying an axial compressive force to said radial sections with said tools to collapse said connecting wall thereby to form a first fold between the connecting wall and the first radial section and a second fold between the connecting wall and the second radial section with the connecting wall connecting said folds and to force at least a portion of the second fold into said recess whereby the connecting wall is spaced from at least a portion of said first radial section.

2. A method of making an easy opening container wall comprising:

providing a piece of sheet material having first and second axially offset radial sections integrally joined by a generally axial connecting wall and with said second radial section having a rib formed thereon adjacent said connecting wall;

scoring said first radial section to define a panel at least partially removable from the piece of sheet material with the line of score being adjacent the connecting wall;

applying an axially directed compressive force to said rib to reduce the axial dimension of the rib and radially spread the rib to thereby tend to incline the connecting wall in a direction so that it extends outwardly as it projects axially inwardly whereby said connecting wall forms with said first and second radial sections a generally Z-shaped cross-section with the first and second sections forming the top and bottom legs of said Z, respectively, and the connecting wall forming the connecting leg thereof;

applying an axial compressive force to said radial sections to thereby at least substantially collapse said connecting wall and to form a first fold between the connecting wall and the first radial section and a second fold between the connecting wall and said second radial section with said connecting wall connecting said sections;

providing a space forming a recess along at least a region of the second radial section adjacent the connecting wall and on the side of the second radial section remote from the first radial section during said step of applying so that the portion of said second fold containing said region is urged into said recess during said step of applying and the connecting wall is spaced from said first radial section adjacent said region; and attaching a tab to the panel whereby said panel can be at least partially removed from the piece of sheet material.

3. A method as defined in claim 2 wherein said rib is completely flattened during said step of applying an axially directed compressive force to said rib.

4. A method of forming an end structure for a container wherein an end blank is successively formed into an end structure which includes an integrally formed rivet for securing a tab to a central panel, a scoreline rupturable to form an opening in the central panel and protective fold means which extends radially outwardly of the scoreline, comprising the steps of:

providing an end blank which includes an attaching flange for connecting the end structure to the wall of a container, the flange peripherally extending around said blank and spaced radially outwardly and vertically above the central panel, said flange being connected to said central panel by a wall portion including first and second axially spaced wall segments, the first of said segments being axially spaced above a second wall segment and joined thereto by a connecting wall thereby forming a first pivot region at the upper end of the connecting wall segment and a second pivot region at the lower end of the connecting wall segment, reforming said end blank with a cooperative die and punch assembly to move said pivot regions relative to each other while forming the scoreline in said first wall segment thereby so reforming the first wall segment such that the latter extends radially of the first pivot region to position the second pivot region radially outward of the first, the first pivot region extending radially inwardly of the second pivot region and being interconnected therewith through the connecting wall segment, the first and second wall segments and said connecting wall segment being generally Z-shaped in cross-section with the first and second wall segments forming the top and bottom legs of said Z, respectively, and the connecting wall forming the connecting leg thereof, the first and second pivot regions defining the portions of the end structure which form the folds of the protective fold means; and axially advancing one of the said first and second wall segments toward the other to axially collapse said connecting wall segment whereby said first pivot region is radially inward of said second pivot region and said scoreline is radially inward of said second pivot region, the line of score defining a segment of said central panel removable therefrom by rupture of said scoreline.

5. A method as set forth in claim 4 wherein during said reforming step includes moving said second pivot region radially outwardly of said first pivot region.

6. A method as set forth in claim 4 wherein said reforming step includes moving said second pivot region radially outwardly of the first pivot region and wherein said step of axially advancing said first and second wall segments includes the use of a first and second tools, said second tool having a recess therein, said tools being so positioned as to be on opposite sides of said first and second wall segments, and said axial advancing step being operative to collapse said connecting wall and to force a portion of said second pivot region into said recess whereby an arcuate portion of said second wall segment is spaced vertically below said first wall segment and said second pivot region is radially outwardly of said first pivot region.

7. A method of forming an end structure for a container wherein an end blank is formed into an end structure which includes means for securing a tab thereto, a scoreline for severance of a central panel from the end wall and protective fold means on said central panel which extends radially outwardly of the scoreline, the improvement which comprises the steps of:

providing an end blank which includes a wall means for attachment to a container body, said wall means being vertically above and radially outwardly of a radially extending central wall which includes first and second axially spaced radial sections integrally joined by a connecting wall which extends axially between said first and second wall sections;

the junction of the first wall section and the upper portion of the connecting wall forming a first pivot region and the junction between the second wall section and the lower portion of the connecting wall forming a second pivot region;

working the end blank between a cooperating die and punch assembly to form a scoreline and to effect movement of at least one of said pivot regions relative to the other whereby said first pivot region is radially inwardly of said second pivot region thereby forming said first wall section and said first pivot region and said connecting wall and said second wall section and said second pivot region into a generally Z-shaped cross-section in which the first and second wall sections form the top and bottom legs of said Z, respectively, and the connecting wall forming the connecting leg thereof; and applying an axial compressive force to said first and second wall sections to collapse said connecting wall whereby said first pivot region is radially inwardly of said second pivot region and said scoreline is radially inwardly of said second pivot region.

8. A method of forming an end structure for a container wherein an end blank is successively formed into an end structure which includes an integrally formed rivet for securing a tab thereto, a scoreline for severance of a central panel from the end wall and protective fold means which extends radially outwardly of the scoreline, said protective fold including a top layer interconnected to a lower layer by an intermediate layer, said intermediate and lower layer forming the protective fold and said scoreline being in the top layer and radially inwardly of the protective fold, comprising the steps of:

providing an end blank which includes a curled peripheral wall for attachment to a container body, the curled peripheral wall being vertically above and radially outwardly of a radially extending central wall which includes first and second axially spaced radial sections integrally joined by a connecting wall which extends between said first and second wall sections;

the junction of the first wall section and the upper portion of the connecting wall forming a first pivot region and the junction between the second wall section and the lower portion of the connecting wall forming a second pivot region;

working the end blank between a cooperating die and punch assembly to form said scoreline and to effect movement of at least one of said pivot regions relative to the other whereby said first pivot region is radially inwardly of said second pivot region thereby forming said first wall section and said first pivot region and said connecting wall and said second wall section and said second pivot region into a generally Z-shaped cross-section in which the first and second wall sections form the top and bottom legs of said Z, respectively, and the connecting wall forming the connecting leg thereof, the scoreline being in said first wall section and radially outwardly of said second pivot region, applying an axial compressive force to said first and second wall sections to collapse said connecting wall whereby said first pivot region is radially inwardly of the second pivot region and said scoreline is radially inwardly of said second pivot region; and staking a tab to said central wall.

9. A method of forming an end structure for a container wherein an end blank is successively formed through an intermediate stage including a Z-shaped fold which is converted to a generally S-shaped protective fold on an end structure which includes an integrally formed rivet for securing a tab thereto, a scoreline for severance of a central panel from the end wall, the S-shaped protective fold being in the central panel and including a top layer interconnected at one end to a flange and at the other end to a lower layer by an intermediate layer, said scoreline being in the top layer of the protective fold formed by the lower and intermediate layer of said S-shaped fold, comprising the steps of:

providing an end blank having a curled peripheral wall for attachment to a container body and including a first radial section connected to and adjacent to and vertically below said peripheral wall and a second radial section axially spaced below said first section, said radial sections being interconnected by a connecting wall located between said radial sections;

the junction of said first radial section and said connecting wall forming a first pivot region and the junction of said second radial section and said connecting wall forming a second pivot region;

working said end blank to form a scoreline in said first radial section and to effect movement of one of said pivot regions relative to the other thereby forming an intermediate stage end blank which includes first and second axially offset radial sections joined by a connecting wall which extends axially, said first and second radial sections and said connecting wall being generally Z-shaped in cross-section with the first and second sections forming the top and bottom legs of said Z, respectively and the connecting wall forming the connecting leg thereof, said intermediate stage end blank including a scoreline in the first wall section, and applying an axially compressive force to said first and second wall sections to collapse said connecting wall thereby converting the Z-shaped fold to a generally S-shaped fold including a radially inwardly projecting bend section and a radially outwardly projecting bend section under said inwardly projecting bend section.

* * * * *